US005571278A

United States Patent [19]

Chiang

[11] Patent Number: 5,571,278

[45] Date of Patent: Nov. 5, 1996

[54] TORCH WITH A BELLOWED INTERMEDIATE FLEXIBLE HOSE MEMBER

[76] Inventor: Hanh Chiang, 162, Chung-Cheng S. Rd., Hsin-Ying Hsiang,Tainan Hsien, Taiwan

[21] Appl. No.: 581,175

[22] Filed: Dec. 29, 1995

[51] Int. Cl.[6] ..... F21L 7/00

[52] U.S. Cl. ..... 362/198; 362/157; 362/205

[58] Field of Search ..... 362/157, 197, 362/198, 202, 205, 208

[56] References Cited

U.S. PATENT DOCUMENTS

| | | | |
|---|---|---|---|
| 3,103,723 | 9/1963 | Becker | 362/198 X |
| 4,443,831 | 4/1984 | Godfrey et al. | 362/198 X |
| 4,733,337 | 3/1988 | Bieberstein | 362/202 X |

*Primary Examiner*—Stephen F. Husar
*Attorney, Agent, or Firm*—Foley & Lardner

[57] ABSTRACT

A torch includes a head member with a bulb unit, a tail member with a cell unit, and an intermediate flexible hose member interconnecting the tail and head members. The bulb unit includes an elongated bulb-holding seat made from an insulated material which has a front end wall, a rear end wall, a C-shaped-cross-sectioned intermediate section which interconnects the front and rear end walls securely, a bulb mounted on the front end wall, a conductive long stick which has a front end connected electrically to the bulb and a rear end fixed on the rear end wall, a conductive front short stick which has a front end connected electrically to the bulb and a rear end, and a conductive rear short stick which has a front end spaced apart from and adjacent to the rear end of the front short stick and a rear end fixed on the rear end wall. The tail member includes a cell unit for supplying power to the bulb unit. The hose member has a conductive front contact set in electrical contact with the rear ends of the long stick and the rear short stick, and a rear contact set in electrical contact with the terminals of the cell unit. Actuation of a switch can interconnect the rear ends of the long stick and the rear short stick each other.

1 Claim, 7 Drawing Sheets

TORCH WITH A BELLOWED INTERMEDIATE FLEXIBLE HOSE MEMBER

BACKGROUND OF THE INVENTION

1. Field of the Invention

The invention relates to a torch, more particularly to a torch with a bellowed intermediate flexible hose member.

2. Description of the Related Art

Referring to FIGS. 1 and 2, a conventional torch 10 is shown to include a head member 12, a tail member 13, and a bellowed intermediate flexible hose member 11. As illustrated, the flexible hose member 11 includes a hose body 111, first and second wires 15 disposed within the hose body 111, and two conductive plug sets 161 respectively provided on two opposite end portions of the wires 15. Each of the head and tail members 12, 13 has two socket sets 171 connected electrically to a corresponding one of a bulb unit on the head member 12 and a cell unit in the tail member 13 by means of wires 17. In assembly, the plug sets 161 of the hose member 11 are inserted into the socket sets 171 of the head and tail members 12, 13. Then, the hose member 11 is attached to both the head and tail members 12, 13 by rivets 19 so as to fix the head and tail members 12, 13 on the end portions of the hose member 11.

The head and tail members 12, 13 cannot be easily removed from the hose member 11 so that in case of disengagement of the plug and socket sets 161, 171 or breakage of wires 17, the torch becomes useless.

SUMMARY OF THE INVENTION

The object of this invention is to provide a torch which includes head and tail members, and a flexible hose member that can be easily removed from one another.

Accordingly, the torch of this invention includes a head member, a tail member, and a bellowed intermediate flexible hose member. The head member includes an externally threaded rear end section, a bulb unit disposed therein, and an on-off switch which is mounted on the head member and which is capable of energizing the bulb unit upon actuation. The tail member includes an externally threaded front end section, and a cell unit for supplying power to the bulb unit. The bulb unit includes an elongated bulb-holding seat made from an insulated material which has a front end wall, a rear end wall and a C-shaped-cross-sectioned intermediate section which interconnects the front and rear end walls securely. The bulb unit further includes a bulb mounted on the front end wall, a conductive long stick which has a front end connected electrically to the bulb and a rear end fixed on an external surface of the rear end wall, a conductive front short stick which has a front end connected electrically to the bulb and a rear end, and a conductive rear short stick which has a front end spaced apart from and adjacent to the rear end of the front short stick and a rear end fixed on the rear end wall. The switch can be actuated to interconnect electrically the rear end of the front short stick and the front end of the rear short stick. The bellowed intermediate flexible hose member has internally threaded front and rear end sections which respectively have front and rear end surfaces and which are respectively provided with conductive front and rear contact sets respectively fixed on the front and rear end surfaces. The hose member is connected threadedly to the head and tail members in such a manner that the front contact set is in electrical touch with the rear ends of the long stick and the rear short stick, while the rear contact set is in electrical touch with terminals of the cell unit.

In the event, the bulb in the torch is damaged, the head and tail members can be easily removed from the hose member, thereby assisting in the replacement thereof.

BRIEF DESCRIPTION OF THE DRAWINGS

Other features and advantages of this invention will become more apparent in the following detailed description of the preferred embodiment with reference to the accompanying drawings, in which.

DETAILED DESCRIPTION OF THE PREFERRED EMBODIMENT

Figure 1:
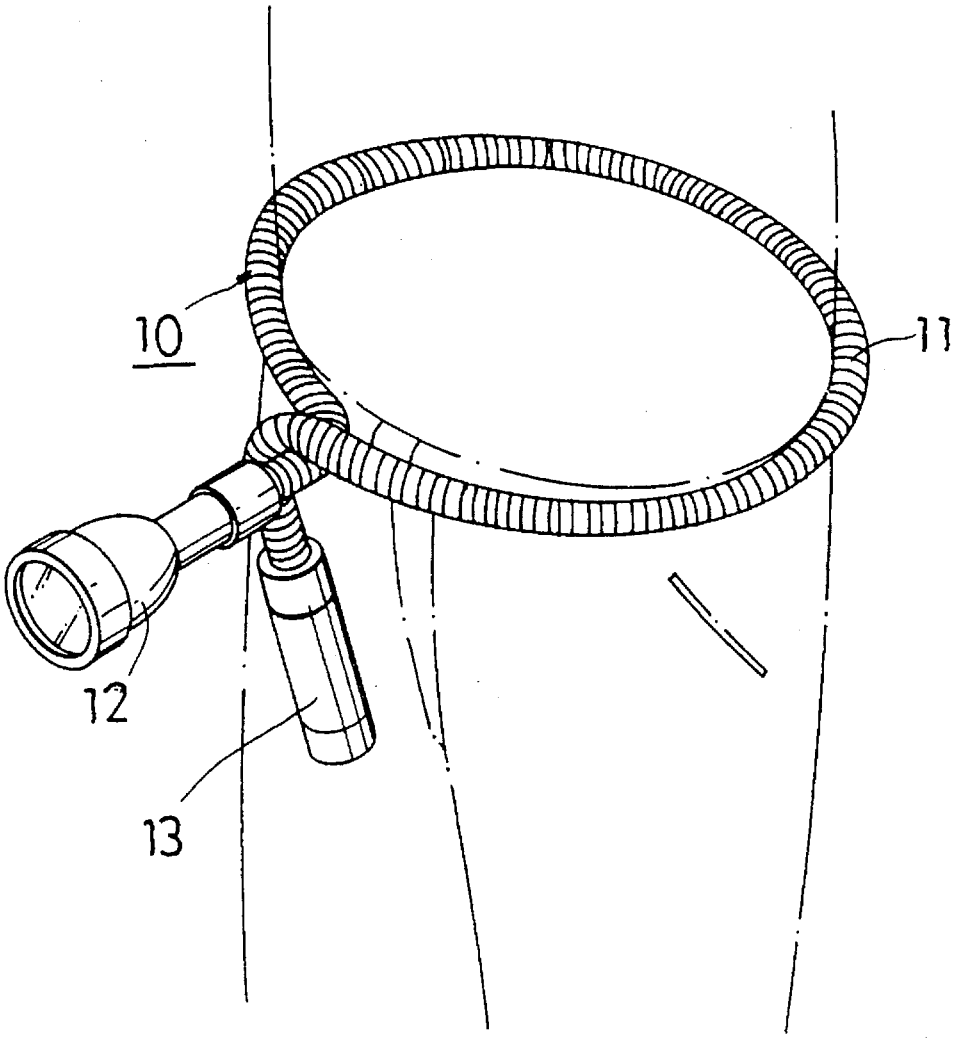
FIG. 1 PRIOR ART
FIG. 1 illustrates how a conventional torch is wrapped around a user's waist.
Figure 2:
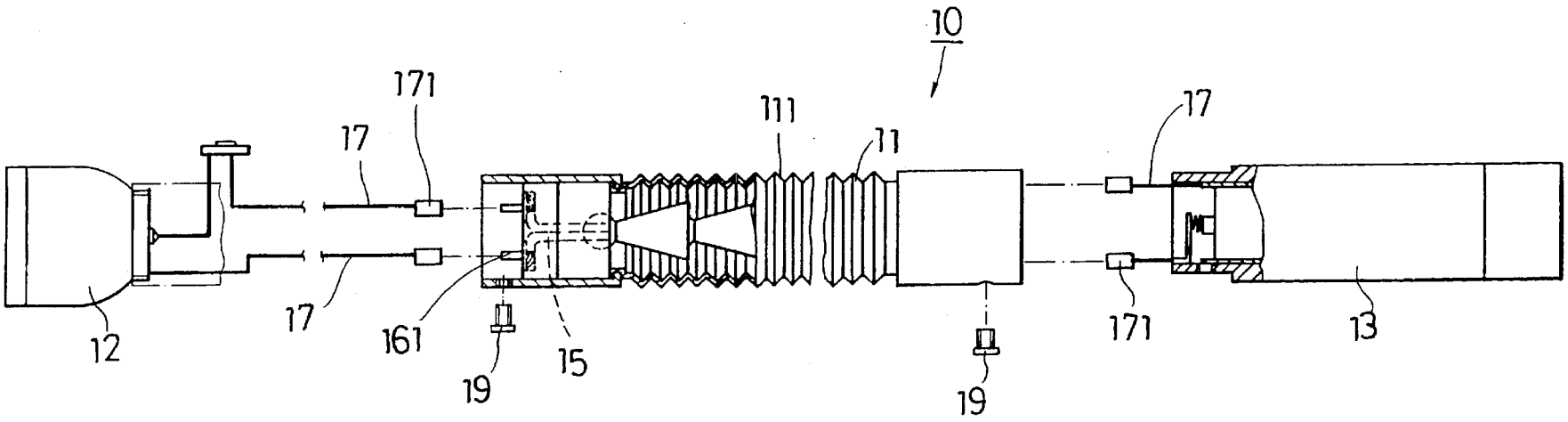
FIG. 2 PRIOR ART
FIG. 2 is an exploded view of the conventional torch shown in FIG. 1.
Figure 3:
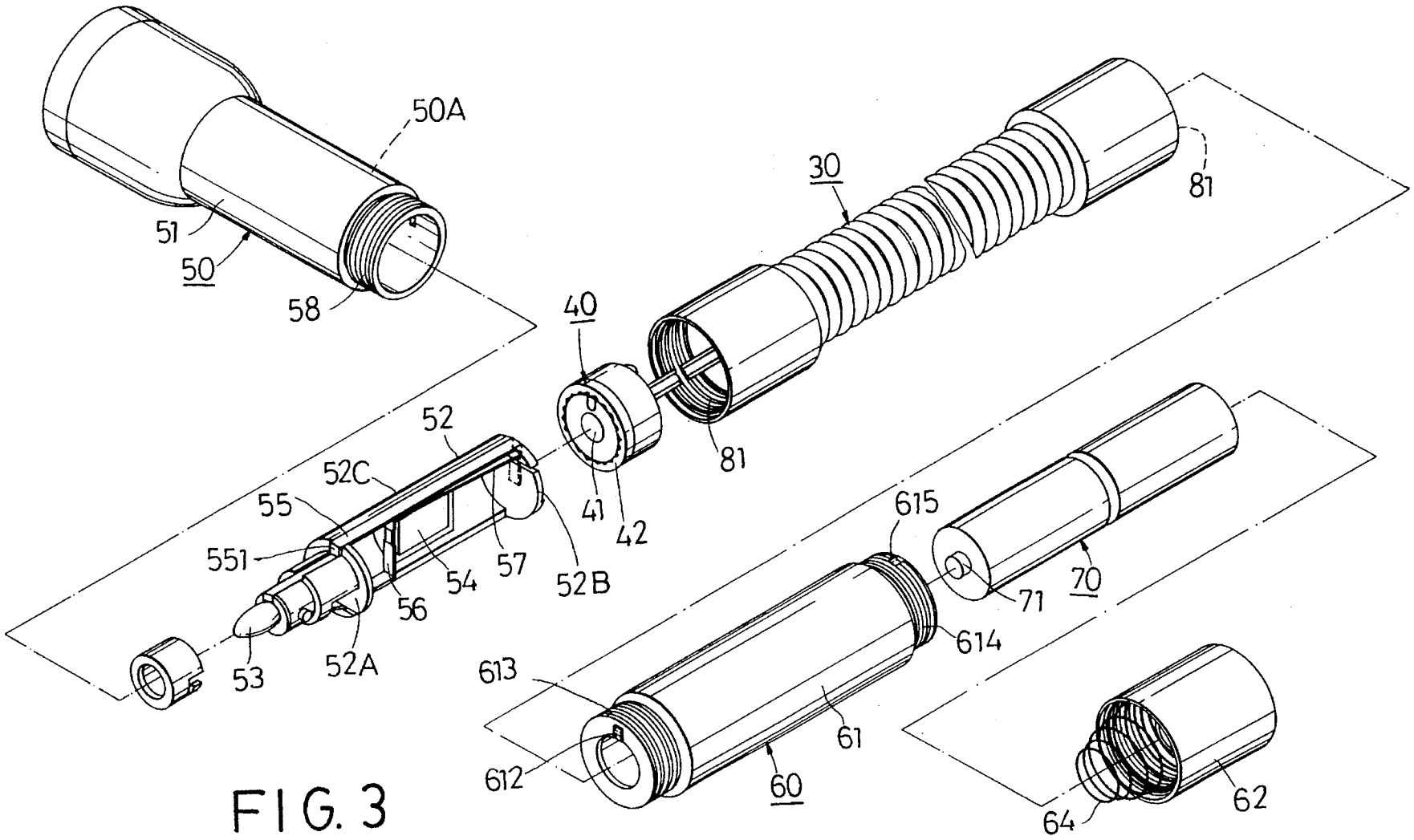
FIG. 3 is an exploded view of a torch of this invention.
Figure 4:
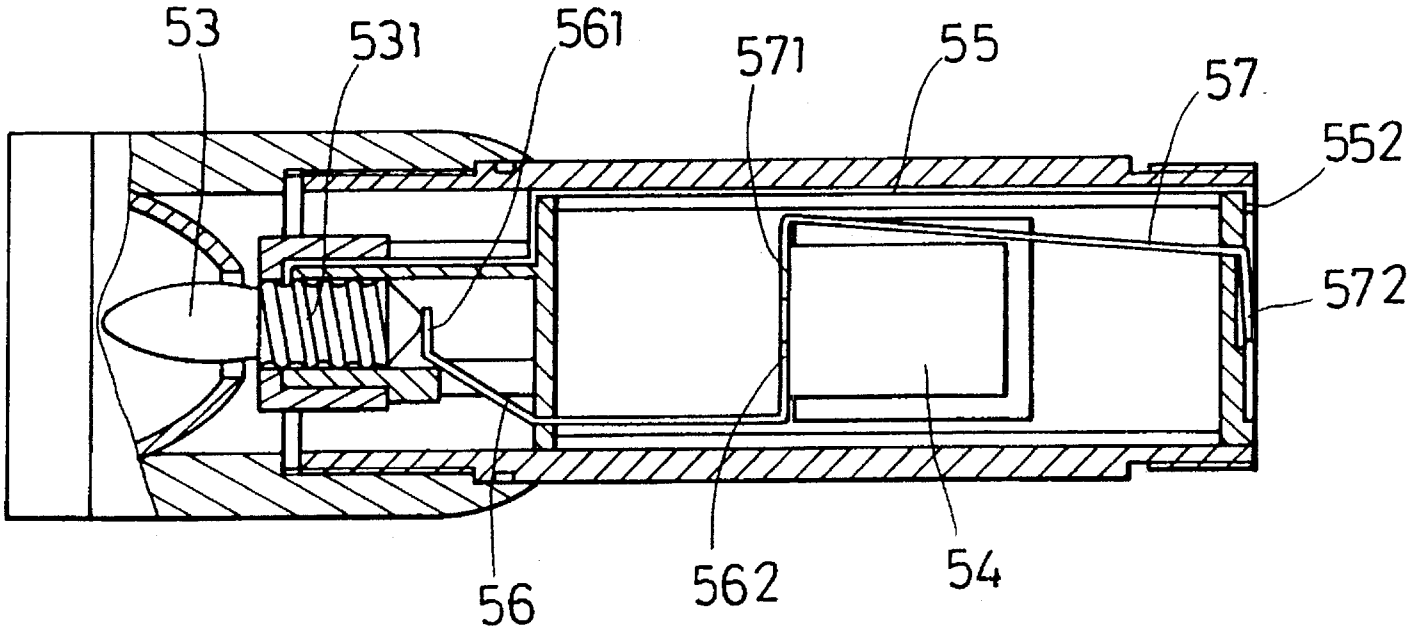
FIG. 4 is a sectional view of a head member of the torch of this invention.

Referring to FIGS. 3 and 4, a torch of this invention includes a head member 50, a tail member 60, and a bellowed intermediate flexible hose member 30.

As illustrated, the head member 50 includes an externally threaded rear end section 58, a bulb unit 52 disposed therein, and an on-off switch 50A (see FIG. 7) which is mounted on the head member 50 and which can energize the bulb unit 52 upon actuation. The bulb unit 52 includes an elongated bulb-holding seat made from an insulated material which has a front end wall 52A, a rear wall 52B, and a C-shaped-cross-sectioned intermediate section 52C which interconnects the front and rear walls 52A, 52B securely. The bulb unit 52 further includes a bulb 53 mounted on the front end wall 52A, a conductive long stick 55 which has a front end 551 connected electrically to the bulb 53 and a rear end 552 fixed on and located on an external surface of the rear end wall 52B, a conductive front short stick 56 which has a front end 561 connected electrically to the bulb 53 and a rear end 562, and a conductive rear short stick 57 which has a front end 571 spaced apart from and adjacent to the rear end 562 of the front short stick 56 and a rear end 572 fixed on the rear end wall 52B. A metal slide piece 54 is connected operatively to the switch 50A and is located above the sticks 56, 57.

The bellowed intermediate flexible hose member 30 has internally threaded front and rear end sections 81 which respectively have front and rear end surfaces 40 (only one is shown in FIG. 3) and which are respectively provided with conductive front and rear contact sets 41, 42 respectively fixed on the front and rear end surfaces 40. The sets 41 are circular while the sets 42 are in the form of a ring.

Figure 5:
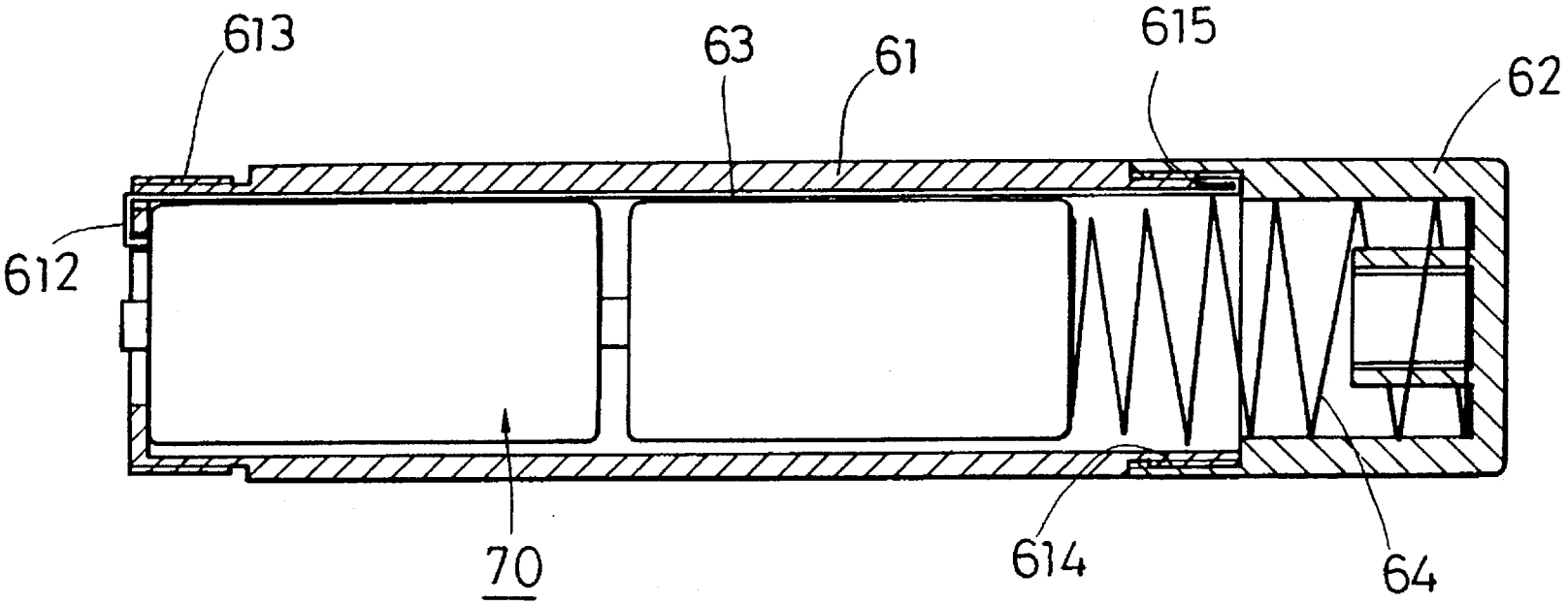
FIG. 5 is a sectional view of a tail member of the torch of this invention.

Referring to FIG. 5, the tail member includes a hollow barrel portion 61 which receives a cell unit 70 therein, and a cap unit 62 mounted detachably on one end of the barrel portion 61 in a known manner. The barrel portion 61 has externally threaded front and rear end sections 613, 614, and an elongated conductive stick 63 (see FIG. 5) which has a front terminal 612 exposed outwardly from the front end of the barrel portion 61, and a rear terminal 615 fixed on the rear end section 614 thereof. The spring 64 in the plug unit 62 biases the cell unit 70 to interconnect electrically the rear terminal 615 of the conductive stick and the negative end of the cell unit 70.

Figure 6:
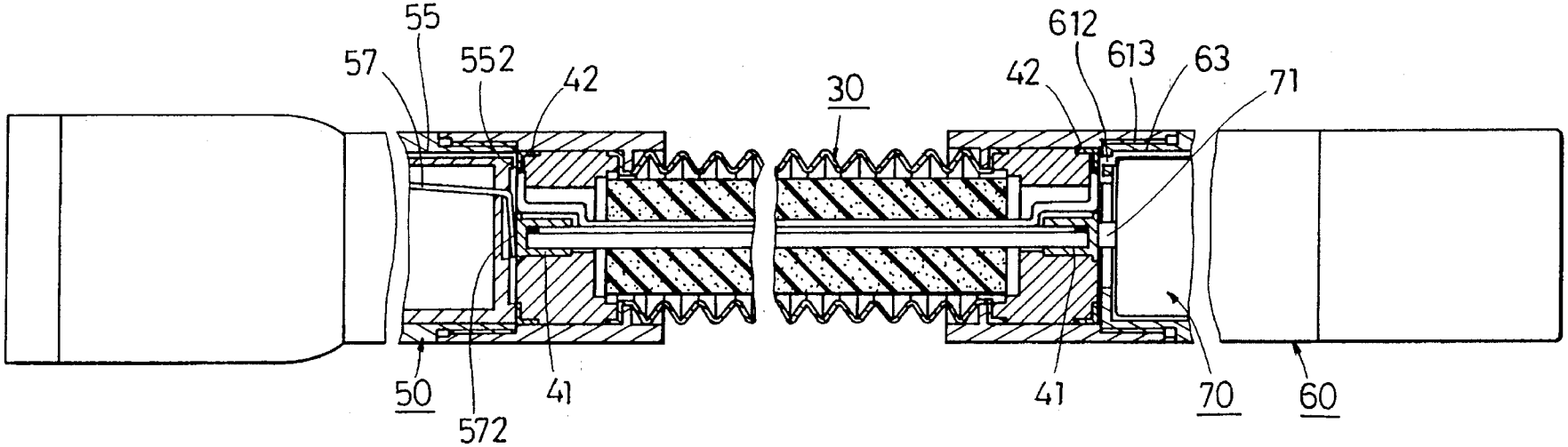
FIG. 6 is a partially sectioned view of a portion of the torch of this invention.

As illustrated in FIG. 6, the hose member 30 is connected threadedly to the head and tail members 50, 60 in such a manner that the front contact set 41, 42 is in electrical touch with the rear ends 552, 572 of the long stick 55 and the rear short stick 57, while the rear contact set 41, 42 is in electrical touch with terminals 71, 613 of the cell unit 70. In this preferred embodiment the front end 612 of the stick 63 serves as one terminal of the cell unit 70.

Figure 7:
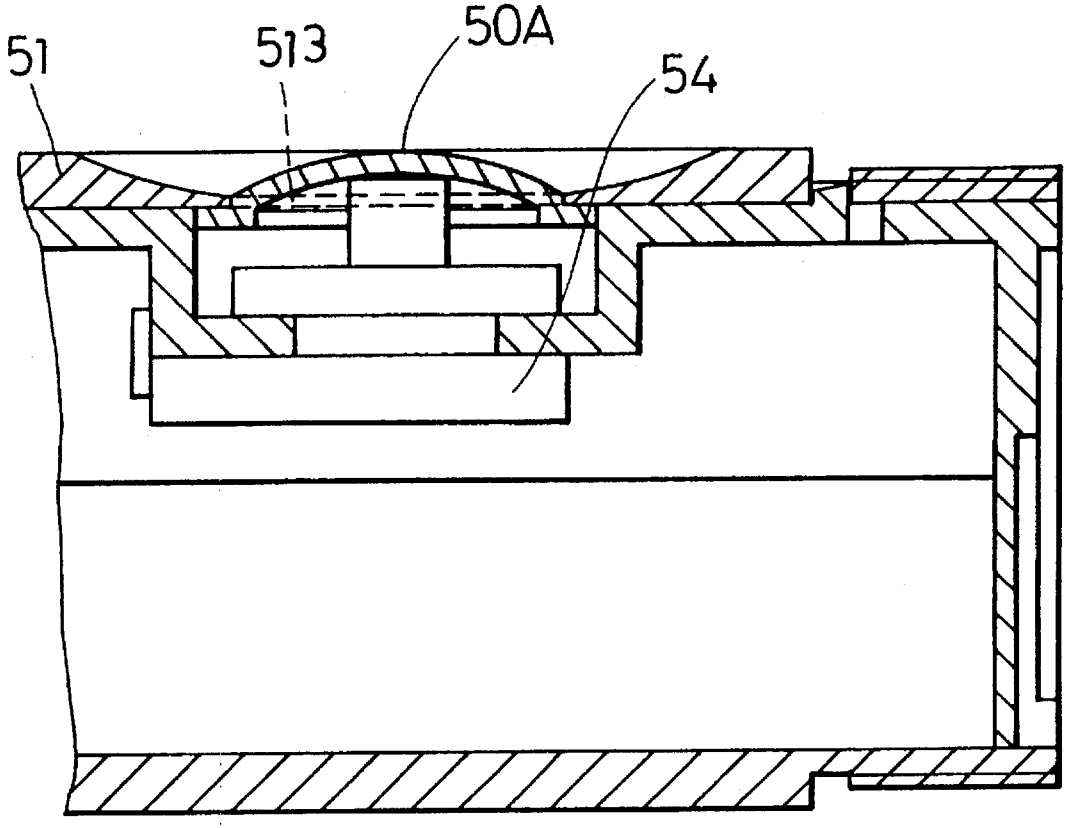
FIG. 7 is a sectional view illustrating arrangement of the electrical contacts of the switch in the torch of this invention.

As illustrated in FIGS. 3, 4 and 7, the switch 50A in this preferred embodiment is a slide switch that can slide along the elongated groove 513 of the wall body 51 of the head member 50 so as to interconnect electrically the rear end 562 of the front short stick 56 and the front end 571 of the rear short stick 57 (see FIG. 4).

In the event, the bulb in the torch of this invention is damaged, the head and tail members 50, 60 can be easily removed from the hose member 30, thereby assisting in replacement of a new bulb.

With this invention thus explained it is obvious to those skilled in the art that various modifications and variations can be made without departing from the spirit and scope of this invention. It is therefore intended that this invention be limited only as in the appended claims.

I claim:

1. A torch comprising:

a head member including an externally threaded rear end section, a bulb unit disposed therein, and an on-off switch which is mounted on said head member and which is capable of energizing said bulb unit upon actuation;

a tail member including an externally threaded front end section, a cell unit for supplying power to said bulb unit;

said bulb unit including an elongated bulb-holding seat made from an insulated material which has a front end wall, a rear end wall and a C-shaped-cross-sectioned intermediate section interconnecting said front and rear end walls securely, said bulb unit further including a bulb mounted on the front end wall, a conductive long stick having a front end connected electrically to said bulb and a rear end fixed on an external surface of said rear end wall, a conductive front short stick having a front end connected electrically to said bulb and a rear end, and a conductive rear short stick having a front end spaced apart from and adjacent to said rear end of said front short stick and a rear end fixed on said rear end wall, said switch being capable of actuated to interconnect electrically said rear end of said front short stick and said front end of said rear short stick; and a bellowed intermediate flexible hose member having internally threaded front and rear end sections which respectively have front and rear end surfaces and which are respectively provided with conductive front and rear contact sets respectively fixed on said front and rear end surfaces, said hose member being connected threadedly to said head and tail members in such a manner that said front contact set is in electrical contact with said rear ends of said long stick and said rear short stick, while said rear contact set is in electrical contact with terminals of said cell unit.

* * * * *